United States Patent [19]

Myslicki et al.

[11] Patent Number: 4,756,565

[45] Date of Patent: Jul. 12, 1988

[54] STRIKER ASSEMBLY

[75] Inventors: Robert J. Myslicki, W. Bloomfield; Carl D. May, Farmington Hills, both of Mich.

[73] Assignee: General Motors Corporation, Detroit, Mich.

[21] Appl. No.: 2,449

[22] Filed: Jan. 12, 1987

[51] Int. Cl.[4] ..... E05B 15/02

[52] U.S. Cl. ..... 292/340; 292/DIG. 43; 292/DIG. 53; 292/341.13; 292/341.18

[58] Field of Search ..... 292/216, 340, 341.12, 292/341.13, DIG. 43, DIG. 53, 341.18, 341.15

[56] References Cited

U.S. PATENT DOCUMENTS

| | | | |
|---|---|---|---|
| 2,624,604 | 1/1953 | Wise | 292/DIG. 43 |
| 2,877,038 | 3/1959 | Kramer | 292/216 |
| 2,917,916 | 12/1959 | Dall | 292/DIG. 43 X |
| 2,930,645 | 3/1960 | Dall | 292/DIG. 43 X |
| 3,796,076 | 3/1974 | Miyabayashi et al. | 292/DIG. 43 X |
| 4,157,844 | 6/1979 | Sarosy et al. | 292/DIG. 43 X |
| 4,225,166 | 9/1980 | Tanaka et al. | 292/DIG. 43 X |
| 4,470,626 | 9/1984 | Gergoe et al. | 292/341.12 |
| 4,602,813 | 7/1986 | Gergoe et al. | 292/340 |
| 4,650,231 | 3/1987 | Shimura et al. | 292/340 |

*Primary Examiner*—Gary L. Smith
*Assistant Examiner*—Eric K. Nicholson
*Attorney, Agent, or Firm*—Herbert Furman

[57] ABSTRACT

A lock striker assembly includes a striker member fixed to a mounting bracket. Studs secured to the bracket extend outwardly through enlarged openings in a body member. Nuts and washers secure the bracket to the member and permit exterior adjustment of the bracket and striker with the closure closed and the lock latched to the striker member. A second bracket is fixed to the inner side of the body member and has a stud extending through an enlarged opening in the first bracket. A nut secures the stud of the second bracket to the first after the position of the first bracket and striker member is fixed. This provides anti-theft protection.

4 Claims, 1 Drawing Sheet

STRIKER ASSEMBLY

This invention relates generally to lock strikers for vehicle bodies and more particularly to an exteriorly adjustable deck lid lock striker assembly which has an anti-theft protection.

The deck lid striker assembly of this invention permits the position of the deck lid within the deck lid opening to be set from the exterior of the vehicle with the deck lid closed and the deck lid lock latched to the deck lid lock striker. Thus, the deck lid can be easily and quickly set in the desired position within the deck lid opening during production of the vehicle.

In the preferred embodiment of the invention, the striker assembly includes a striker member fixed to a first mounting bracket located interiorly or within the deck compartment. The mounting bracket mounts threaded studs which extend outwardly to the exterior of the vehicle through enlarged apertures in the rear end panel of the vehicle. Exterior nut assemblies are threaded on the studs to mount the striker member to the end panel. After the nut assemblies are frictionally tightened against the exterior side of the end panel, the deck lid is closed to latch the deck lid lock to the striker member. The deck lid can then be adjusted to the desired position within the deck lid opening of the vehicle as the studs move within the enlarged openings of the end panel and the nut assemblies frictionally move relative to the exterior side of such panel. Once the desired position is set, the nut assemblies are tightened to fix the position of the first mounting bracket and striker member within the deck compartment of the vehicle.

Since the nut assemblies are accessible from the exterior of the vehicle, anti-theft protection is provided to ensure that the deck lid striker cannot be dismounted from the vehicle should such nut assemblies be removed. The anti-theft protection includes a second mounting bracket secured to the interior side of the end panel and provided with a stud which extends through an enlarged opening of the striker member or first mounting bracket. Once the position of the deck lid within the deck lid opening is fixed, a nut assembly threaded on the stud of the second mounting bracket prevents dismounting of the first mounting bracket should the exterior nut assemblies be removed in an attempt to gain unauthorized access to the deck compartment.

One feature of this invention is that it provides an improved striker assembly for vehicle deck lids which permits such deck lids to be adjusted to the desired position within the deck lid opening of the vehicle with the deck lid closed and the deck lid lock latched to the deck lid striker. Another feature is that the deck lid striker is mounted to the vehicle by exteriorly accessible attachment means so that all adjustment is accomplished from the exterior of the vehicle. A further feature is that the striker assembly includes interiorly accessible attachment means which is set after setting of the exteriorly accessible attachment means to ensure that removal of the exteriorly accessible attachment means does not permit access to the deck compartment of the vehicle by dismounting of the deck lid striker from the vehicle.

These and other features will be apparent from the following specification and drawing wherein.

The striker assembly of this invention is intended for use with a vehicle having a conventional rear or deck compartment which is opened and closed by a conventional deck lid which is hinged adjacent its forward edge to the vehicle for opening and closing movement relative to the deck compartment. The rear edge of the deck lid mounts a conventional deck lid latch which includes a conventional latch bolt for latching engagement to and unlatching disengagement from a striker assembly 10 according to this invention.

Figure 1:
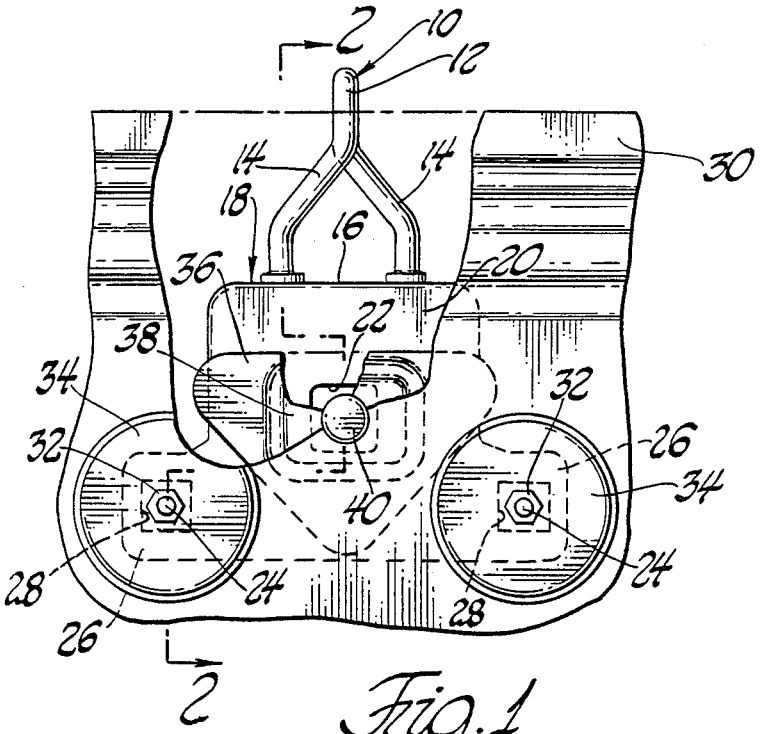
FIG. 1 is a partially broken away exterior view of a striker assembly according to this invention mounted on the end panel of a vehicle.
Figure 2:
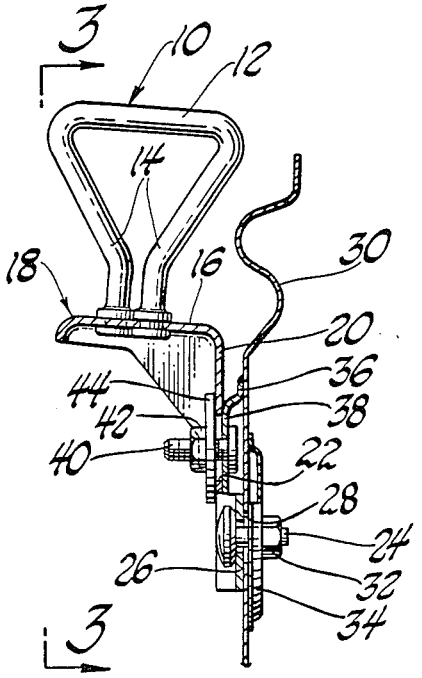
FIG. 2 is a sectional view taken on line 2—2 of FIG. 1.
Figure 3:
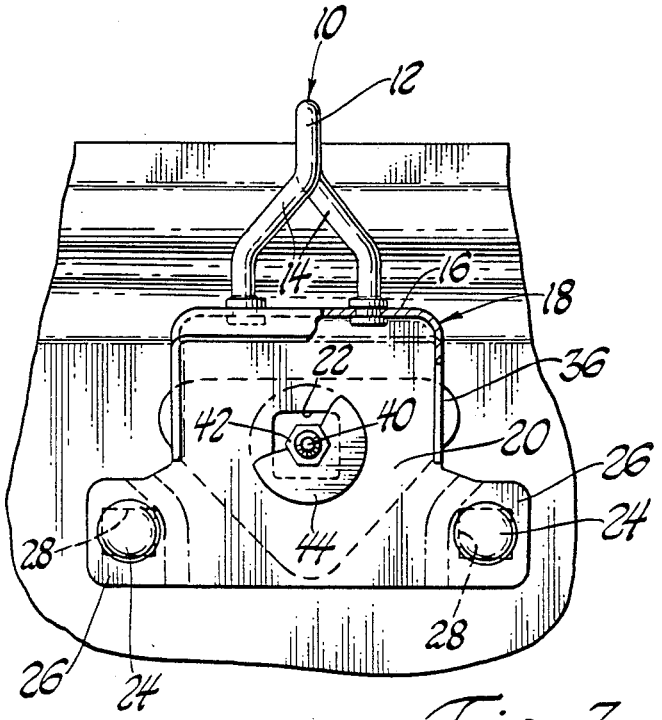
FIG. 3 is a partially broken away interior view similar to FIG. 1.

The striker assembly 10 includes a rod striker member 12 of U-shaped configuration having oppositely offset legs 14 which are staked to the flanged horizontal or upper leg 16 of a bracket or striker member mounting member 18. Member 18 includes a rear or vertical leg 20 having an enlarged generally square shaped aperture 22. The side flanges of leg 16 continue along portions of the side edges of leg 20, as can be seen in FIG. 2. A pair of headed studs 24 have their head welded to offset portions 26 of the leg 20. The threaded shanks of the studs extend rearwardly and outwardly of the vehicle through enlarged circular openings 28 in the end panel 30 of the vehicle. The end panel extends transversely of the vehicle and defines the rearward wall of the deck compartment of the vehicle. Nut assemblies 32, which include washers 34 assembled to the nuts thereof, are threaded on the shanks of the studs 24 and engage the exterior side of the end panel 30 to hold the offset portions 26 against the inner side of the end panel 30 and releasably fix the position of the striker assembly 10 on the end panel.

In order to set the position of the deck lid relative to the opening of the deck compartment, the studs 24 of the striker assembly 10 are inserted through the openings 28 of the end panel 30 and the nut assemblies 32 are then threaded on the shanks of the studs and partially tightened to frictionally engage washers 34 against the exterior side of the end panel. The deck lid is then closed and the deck lid latch engaged with the striker member 12. The deck lid is then adjusted relative to the opening of the deck compartment as the studs 24 move within the openings 28 of the end panel and the washers 34 move relative to the exterior side of the end panel 30. Once the position of the deck lid is set, the nut assemblies 32 are fully tightened to fix such position.

The striker assembly of this invention also includes anti-theft protection to prevent unauthorized entry into the deck compartment upon removal of the nut assemblies 32. A generally triangularly shaped mounting bracket or mounting member 36 is welded to the interior side of the end panel 30 about the periphery thereof. The center portion 38 of the mounting member 36 is apertured and offset outwardly or forwardly of the vehicle. A headed stud 40 has its head seating against and welded to the rearward side of the center portion 38. The threaded shank of the stud 40 extends forwardly through the aperture in the offset portion 38. The aperture 22 of the leg 20 of the mounting member 18 receives the shank of the stud 40 therethrough. A nut assembly 42, including a washer 44, is threaded on the shank of the stud 40 and seats against leg 20 to clamp the mounting member 18 to the mounting member 36 and seat the offset portions 26 against the interior side of the end panel 30. The nut assembly 42 can be loosely assembled to the shank of stud 40 before the deck lid position is finally set and then finally tightened by opening the deck lid to gain access thereto after the position of the deck lid is set, as previously described herein. Once the nut assembly 42 is in place, it will block any dismounting of the striker assembly 10 should the nut assemblies 32 be removed. Thus, the deck lid will remain closed and latched in place to block unauthorized entry into the deck compartment.

Thus this invention provides an improved striker assembly which includes exteriorly accessible attachment means which permits adjustment of the position of a deck lid within a deck compartment opening with the deck lid closed and latched to the vehicle and which includes anti-theft protection against unauthorized entry into such deck compartment should the exterior attachment means be removed.

The embodiments of the invention in which an exclusive property or privilege is claimed are defined as follows:

1. In combination with a vehicle having a compartment which is defined in part by a vehicle panel having interior and exterior sides and an aperture therethrough, a vehicle closure which is mounted on the vehicle for movement between open and closed positions with respect to the compartment, and latch means mounted on the closure, a lock striker assembly mounted on the vehicle panel comprising, a lock striker support member having an aperture therethrough, a lock striker mounted to the support member for engagement by the latch means to hold the closure in closed position, first stud means secured to the lock striker support member and extending through the vehicle panel aperture to the exterior side of the vehicle panel, nut means threaded on the stud means on the exterior side of the vehicle panel for securing the stud means to the exterior side of the vehicle panel, the stud means being of lesser size than the vehicle panel aperture to permit the stud means to be engaged from the exterior side of the vehicle panel and moved within the vehicle panel aperture to adjust the lock striker support member and lock striker relative to the compartment when the closure is in closed position and the latch means is engaged with the lock striker, and anti-theft means preventing release of the lock striker support member from the vehicle panel and movement of the closure from closed position to open position should the nut means be released, the anti-theft means including second stud means mounted to the interior side of the vehicle panel and extending through the aperture in the lock striker support member, and second nut means threadedly securing the lock striker support member to the second stud means after the lock striker support member has been secured to the vehicle panel, the second stud means being of lesser size than the lock striker support member aperture to permit adjustment of the lock striker support member and first stud means relative to the second stud means.

2. In combination with a vehicle having a compartment which is defined in part by a vehicle panel having interior and exterior sides and an aperture therethrough, a vehicle closure which is mounted on the vehicle for movement between open and closed positions with respect to the compartment, and latch means mounted on the closure, a lock striker assembly mounted on the vehicle panel comprising, a lock striker support member having an offset portion provided with an aperture therethrough, a lock striker mounted to the support member for engagement by the latch means to hold the closure in closed position, first stud means secured to the lock striker support member and extending through the vehicle panel aperture to the exterior side of the vehicle panel, nut means threaded on the stud means on the exterior side of the vehicle panel for securing the stud means to the exterior side of the vehicle panel, the stud means being of lesser size than the vehicle panel aperture to permit the stud means to be engaged from the exterior side of the vehicle panel and moved within the vehicle panel aperture to adjust the lock striker support member and lock striker relative to the compartment when the closure is in closed position and the latch means is engaged with the lock striker, and anti-theft means preventing release of the lock striker support member from the vehicle panel and movement of the closure from closed position to open position should the nut means be released, the anti-theft means including a mounting member mounted to the interior side of the vehicle panel for seating the offset portion of the lock striker support member, second stud means mounted to the mounting member and extending through the aperture in the offset portion of the lock striker support member, and second nut means threadedly securing the lock striker support member to the second stud means after the lock striker support member has been secured to the vehicle panel, the second stud means being of lesser size than the lock striker support member aperture to permit adjustment of the lock striker support member and first stud means relative to the second stud means.

3. In combination with a vehicle having a compartment which is defined in part by a vehicle panel having interior and exterior sides and a pair of spaced apertures therethrough, a vehicle closure which is mounted on the vehicle for movement between open and closed positions with respect to the compartment, and latch means mounted on the closure, a lock striker assembly mounted on the vehicle panel comprising, a lock striker support member having an aperture therethrough, a lock striker mounted to the support member for engagement by the latch means to hold the closure in closed position, first and second stud means secured to the lock striker support member and triangulated with respect to the support member aperture, the first and second stud means extending through respective vehicle panel apertures to the exterior side of the vehicle panel, first and second nut means respectively threaded on the first and second stud means on the exterior side of the vehicle panel for securing such stud means to the exterior side of the vehicle panel, the first and second stud means being of lesser size than their respective vehicle panel apertures to permit such stud means to be engaged from the exterior side of the vehicle panel and moved within their respective vehicle panel apertures to adjust the lock striker support member and lock striker relative to the compartment when the closure is in closed position and the latch means is engaged with the lock striker, and anti-theft means preventing release of the lock striker support member from the vehicle panel and movement of the closure from closed position to open position should the nut means be released, the anti-theft means including third stud means mounted to the interior side of the vehicle panel and extending through the aperture in the lock striker support member, and third nut means threadedly securing the lock striker support member to the third stud means after the lock striker support member has been secured to the vehicle panel, the third stud means being of lesser size than the lock striker support member aperture to permit adjustment of the lock striker support member and first and second stud means relative to the third stud means.

4. In combination with a vehicle having a compartment which is defined in part by a vehicle panel having interior and exterior sides and a pair of spaced apertures therethrough, a vehicle closure which is mounted on the vehicle for movement between open and closed positions with respect to the compartment, and latch means mounted on the closure, a lock striker assembly mounted on the vehicle panel comprising, a lock striker support member having an offset portion provided with an aperture therethrough, a lock striker mounted to the support member for engagement by the latch means to hold the closure in closed position, first and second stud means secured to the lock striker support member and triangulated with respect to the support member aperture, the first and second stud means extending through respective vehicle panel apertures to the exterior side of the vehicle panel, first and second nut means respectively threaded on the first and second stud means on the exterior side of the vehicle panel for securing such stud means to the exterior side of the vehicle panel, the first and second stud means being of lesser size than their respective vehicle panel apertures to permit such stud means to be engaged from the exterior side of the vehicle panel and moved within their respective vehicle panel apertures to adjust the lock striker support member and lock striker relative to the compartment when the closure is in closed position and the latch means is engaged with the lock striker, and anti-theft means prevent release of the lock striker support member from the vehicle panel and movement of the closure from closed position to open position should the nut means be released, the anti-theft means including a mounting member mounted to the interior side of the vehicle panel for seating the offset portion of the lock striker support member, third stud means mounted to the mounting member and extending through the aperture in the offset portion of the lock striker support member, and third nut means threadedly clamping the offset portion of the lock striker support member to the third stud means after the lock striker support member has been secured to the vehicle panel, the third stud means being of lesser size than the lock striker support member aperture to permit adjustment of the lock striker support member and first and second stud means relative to the third stud means.

* * * * *